US009370081B2

(12) United States Patent
Josefides

(10) Patent No.: US 9,370,081 B2
(45) Date of Patent: Jun. 14, 2016

(54) SYSTEM AND METHOD FOR A DELAYED LIGHT SWITCH NETWORK

(71) Applicant: Antonio Pantolios Josefides, Montevideo (UY)

(72) Inventor: Antonio Pantolios Josefides, Montevideo (UY)

( * ) Notice: Subject to any disclaimer, the term of this patent is extended or adjusted under 35 U.S.C. 154(b) by 217 days.

(21) Appl. No.: 13/858,331

(22) Filed: Apr. 8, 2013

(65) Prior Publication Data

US 2013/0328494 A1 Dec. 12, 2013

Related U.S. Application Data

(63) Continuation-in-part of application No. 13/305,735, filed on Nov. 28, 2011, now abandoned.

(51) Int. Cl.
*H05B 37/02* (2006.01)
*H05B 39/04* (2006.01)
*H05B 41/36* (2006.01)

(52) U.S. Cl.
CPC ..... *H05B 37/0236* (2013.01); *H05B 37/029* (2013.01)

(58) Field of Classification Search
CPC ..... H05B 37/0236
USPC ..... 315/210–217
See application file for complete search history.

(56) References Cited

U.S. PATENT DOCUMENTS

| | | | | |
|---|---|---|---|---|
| 4,344,071 | A * | 8/1982 | Allen | H03K 17/28 307/117 |
| 5,423,049 | A * | 6/1995 | Kurihara | G06F 15/17 710/262 |
| 6,188,986 | B1 * | 2/2001 | Matulich | G10L 15/26 704/275 |
| 6,324,514 | B2 * | 11/2001 | Matulich | 704/275 |
| 7,765,033 | B2 * | 7/2010 | Perry | H05B 37/0227 700/14 |
| 2002/0044066 | A1 * | 4/2002 | Dowling | A63J 17/00 340/815.46 |
| 2005/0288731 | A1 * | 12/2005 | Shames | A61N 1/36014 607/48 |
| 2008/0218372 | A1 * | 9/2008 | Schoettle | H05B 37/0236 340/7.62 |

* cited by examiner

*Primary Examiner* — Sibin Chen
*Assistant Examiner* — Metasebia Retebo
(74) *Attorney, Agent, or Firm* — Spradley PLLC; Michael Spradley

(57) ABSTRACT

A delayed light switch system and method is described herein. Such delayed light switch system can comprise a microphone in a first zone, a light switch, and a central computing system that connects to said microphone and said light switch, wherein said central computing system receives an audio signal from said microphone, said audio signal related to a sound detected by said microphone, waits for a delay time to pass, and transmits a first control signal to said light switch to turn said light switch on.

12 Claims, 14 Drawing Sheets

KEY

Q1,Q2 – MPSA44
R1,R2 – 3.3K
R3,R4 – 1.5M
R5 – 82, R6 – 1K
R7,R36 – 4.7M
R11,R13,R16,R17,R38 – 10M
R12, R15 – 1.5M
R14 – 2.2M
R32,R35 – 100K
R33 – 2.7M
R34 – 1M
R37 – 2.2M
IC1 – 12F635
C1 – 16V 220uF
C2 – 470nF
C3, C31 – 10uF
C11, C13, C16 – 1nF
C12, C15, C34 – 10nF
C14, C32, C35 – 100nF
C33 – 100pF
Z2 – 6v2
VR1 – 470K (50%)

SYSTEM AND METHOD FOR A DELAYED LIGHT SWITCH NETWORK

BACKGROUND

This disclosure relates to a system for a delayed light switch network.

During recent years, burglary has been one of the most common crimes in America. Most of these incidents occur when premises are left unoccupied or unattended. Having a properly lit vicinity can be an effective way to deter burglars and intruders. There are different ways and techniques developed for home security lighting. A common method is the dusk to dawn technique, which works by having the lights turned on all the time. However, this method can be expensive due to power consumption cost. Additionally, without any changes in the light activity, burglars may think that the territory is left unguarded. Such assumption may give the intruders an idea to proceed with a burglary.

Another security lighting technique uses motion sensors, which when triggered, illuminates the affected areas instantly. However, the intruder may infer that the instant illumination of the area he occupies was triggered by an automatic response of a security lighting technique, because the instantaneous response of illumination is characterized by a machine and not indicative of a human reaction. In such case, the intruder may not be intimidated and instead be reassured that the premise was left unprotected.

It would therefore be advantageous to implement a system and method for delaying a light switch network.

SUMMARY

A system and method for delaying a light switch network is described herein. Specifically, a delayed light switch system is disclosed.

Such delayed light switch system can comprise a microphone in a first zone, a light switch, and a central computing system that connects to said microphone and said light switch, wherein said central computing system receives an audio signal from said microphone, said audio signal related to a sound detected by said microphone, waits for a delay time to pass, and transmits a first control signal to said light switch to turn said light switch on. The delayed light switch system can also waits for a countdown time to pass, and sends a second control signal to said light switch to turn said light switch off.

In one embodiment, the delayed light switch system can also comprise a microphone that converts a noise into an analog signal, and an amplifier that receives said audio signal from said microphone, and converts said audio signal into an amplified audio signal. The delayed light switch system can further comprise a delay that receives said amplified audio signal from said amplifier, and applies a delay time to said amplified audio signal, and a microcontroller than upon receiving said amplified analog signal above a first predetermined threshold sends a control signal to turn on a light.

In another embodiment, the delayed light switch system can comprise a delay switch that in a closed position allows said delay from transmitting said amplified audio signal, in an open position prevents said delay from transmitting said amplified audio signal. Furthermore, the delayed light switch system can comprise a trigger counter that, upon receiving said amplified analog signal above a second predetermined threshold, generates a counter time, and transmits a counter time. Moreover, the delayed light switch system can further comprise a counter switch that in a closed position, allows said trigger counter to receive said amplified analog signal from said amplifier, and in an open position, prevents said trigger counter from receiving said amplified analog signal from said amplifier. The delayed light switch system can also comprise a microcontroller that receives said counter time from said trigger counter, switches said delay switch from a closed position to an open position, and switches said counter switch from a closed position to an open position, waits until counter time passes, sends a control signal to turn off said light, switches said delay switch from an open position to a closed position, and switches said counter switch from an open position to a closed position.

Additionally, a method for deterring a burglar is disclosed. The method can comprise detecting a sound in a first zone with a microphone in said first zone waiting for a first delay time to pass, and switching a first light on using a system comprising said microphone. The method can also comprise steps waiting for a second delay time to pass, and switching a second light on using said system, wherein said second light is in a second zone. The method can further comprise steps waiting for a second delay time to pass, and switching said second light on using said system, wherein said second light is in a first zone.

DETAILED DESCRIPTION

Described herein is a system and method for delaying lighting in a switch network or light switch network. The following description is presented to enable any person skilled in the art to make and use the invention as claimed, and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
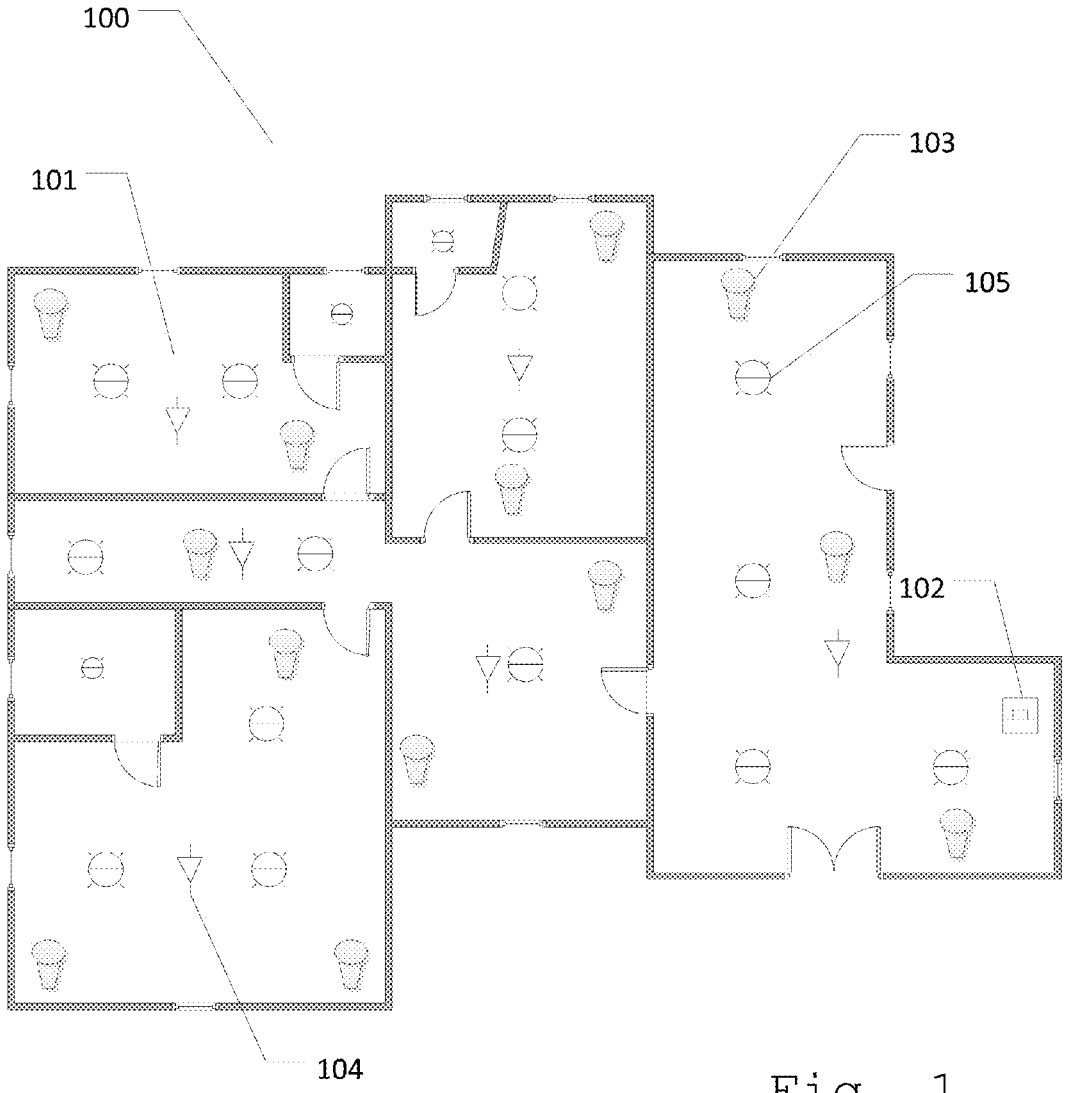
FIG. 1 illustrates a monitored area of a premise.

FIG. 1 illustrates a monitored area 100 of a premise. Monitored area 100 can comprise one or more zones 101. In one embodiment, zone 101 can comprise one or more delayed light switch 102, one or more microphone 103, one or more amplifier 104 and one or more lighting device 105. For purpose of this disclosure, monitored area 100 is defined as the total area that is within functional range of any delayed light switch 102, any microphone 103, any amplifier 104 or any lighting devices 105.

In one embodiment, delayed light switch 102 can be affixed or mounted on any walls or structures within monitored area 100. In another embodiment, microphone 103 and amplifier 104 can mount to light switch 102 as one device. In such embodiment, microphone 103, amplifier 104, and light switch 102 can be coupled as one device. Delayed light switch 102 can be placed inside or outside buildings.

In another embodiment, amplifier 104 can mount to microphone 103. In such embodiment, microphone 103 and amplifier 104 can be coupled as one device. Moreover, in such embodiment, microphones 103 can be affixed on fixtures within monitored area 100. Such fixtures can be tables, chairs and/or a mounting structure specifically manufactured for supporting microphone 103. Microphones 103 can be placed inside or outside buildings.

Figure 2:
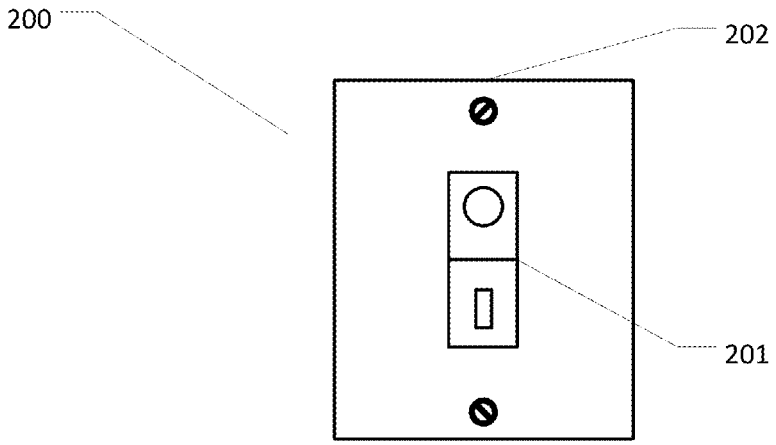
FIG. 2 illustrates one embodiment of delayed light switch.

FIG. 2 illustrates one embodiment of delayed light switch 102. In such embodiment, light switch 102 can comprise a switch 201, and a switch plate 202. Switch 201 can be any type of switch which includes but not limited to any hand switch, any limit switch, or any process switch. In one embodiment, light switch 102 can have an "ON" and "OFF" button. In such embodiment, light switch 102 can have two or more settings, such as "ON", "OFF" and "STAND-BY". In an embodiment wherein light switch 102 can have an "ON" and "OFF" button, pressing the "ON" button turns the light on, and pressing the "OFF" button turns the light off. Further, in such embodiment, pressing the "OFF" button with 3 or more seconds of pressure sets light switch 102 to "STAND-BY". In another embodiment, light switch 102 can have three or more buttons and/or switches to indicate "ON", "OFF", or "STANDBY" status. Further, for purposes of this disclosure, light switch 102 can be controlled manually, wirelessly or in a combination of both.

Figure 3A:
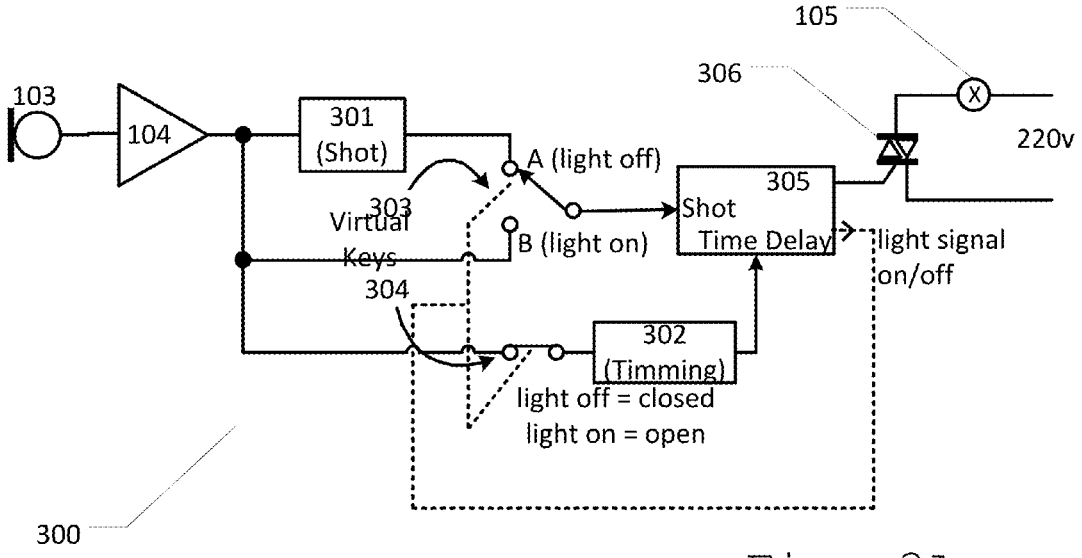
FIG. 3A illustrates an analog electrical circuit diagram disclosing how a lighting device is turned off according to the detection of a noise.
Figure 3B:
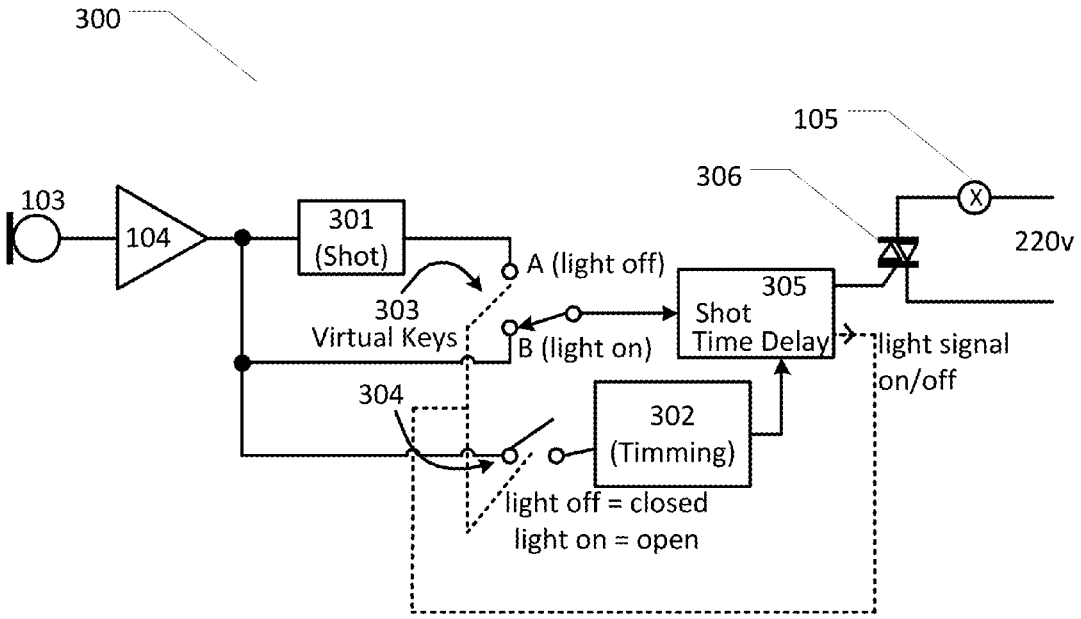
FIG. 3B illustrates an analog electrical circuit diagram disclosing how a lighting device is turned on according to the detection of a noise.

FIGS. 3A and 3B illustrate an analog electrical circuit diagram disclosing how a lighting device is turned on/off according to the detection of a noise. Analog delayed light switch 102 can comprise microphone 103, amplifier 104, delay 301, a trigger counter 302, a delay switch 303, a counter switch 304, a microcontroller 305, a triode alternating current switch (TRIAC) 306, and a lighting device 105. For purposes of this disclosure, delay 301 and counter 302 can be any integrated circuit (IC), chip, or microchips. Delay 301 can be any timer IC, while trigger counter 302 can be any random number generator IC. Further, microcontroller 305 can be a single IC that can comprise any processor, any memory, and/or any input/output device. TRIAC 306 or triode alternating current switch is a semiconductor device that acts as a voltage-driven switch. As such, TRIAC 306 is used to enable voltage to be controlled between zero and full power.

In an embodiment, wherein light switch 102 is turned "OFF" and/or in "STAND-BY" mode, as seen in FIG. 3A, and microphone 103 can detect a sound, microphone 103 can convert the sound wave to an analog signal and transmits it to amplifier 104. Amplifier 104 can intensify the analog signal. From amplifier 104, the amplified analog can be sent directly to delay 301. When delay 301 receives amplified analog signal, it can delay the amplified signal from reaching delay switch 303 for a period of time, said period of time hereinafter referred to as "delay time." From amplifier 104, the amplified analog signal can also be sent directly to counter switch 304. When counter switch 304 is in the closed position, amplified signal can reach trigger counter 302. Each time the amplified analog signal reaches a first operable threshold, trigger counter 302 can generate a random counter time and send the counter time to microcontroller 305, said counter time between a counter minimum, and a counter maximum. Microcontroller stores counter time in its internal memory. In one embodiment, if trigger counter 302 generates a new counter time, then microcontroller 305 can overwrite the prior counter time. In another embodiment, microcontroller can ignore subsequent generations.

After the delay time, amplified analog signal can reach delay switch 304 301 to microcontroller 305. When the amplified analog signal reaches microcontroller from delay 301 is received by microcontroller 305 above a second operable threshold, microcontroller 305 can switch the position of delay switch 303 and counter switch 304, as seen in FIG. 3B, and can send a trigger pulse to TRIAC 306 to turn "ON" lighting device 105. In one embodiment, the first operable threshold and the second operable threshold are equal. In another embodiment, one or each is zero. As such, any new sound signal received by microphone 103 will neither go to microcontroller from delay 301 nor to counter 302 from amplifier 104. Thus at lights on position, trigger counter 302 stops generating random numbers to send to microcontroller 305. In one embodiment, microcontroller 305 can start counting down starting at counter time, from immediately after receiving counting time. In such embodiment, counter time should be greater than delay time. In another embodiment, microprocessor should begin counting down from counter time after microcontroller switches the position of delay switch and counter switch. Once microcontroller 305 counts down to zero, microcontroller 305 can switch the position of delay switch 303 and counter switch 304 back to their original position, and microcontroller 305 can send a trigger pulse to TRIAC 305 to turn "OFF" lighting device 105. A person skilled in the art should recognize that there are many ways to turn a light on and off from a microprocessor, and the use of TRIAC 305 is exemplary, and not limiting.

For purposes of this disclosure, time delay can be preset by the system or can be pre-set by the user. In one embodiment user can choose any delay lights on time values, for example values can range from 5 to 25 seconds. In one embodiment, an additional counter in the microprocessor rather than a separate time delay IC can accomplish time delay.

The positions of delay switch 303 and counter switch 304 changes to lights on state once delay 301 reaches its final count of delay lights on. As such, any new signal coming from amplifier 104 will not travel to counter 302. Thus at lights on position, counter 302 stops generating random numbers, and holds the value of the last number generated then sends this time delay value to microcontroller 305.

For the purpose of this disclosure the time delay value in counter 302 can be randomly generated or pre-set by the user. In one embodiment, time delay value can be randomly generated or can have pre-determined settings. In another embodiment user can set any time value for counter 302, whose values can range from zero to 320 minutes.

In such lights on state, as seen in FIG. 3B, microcontroller 305 connects directly to amplifier 104, awaiting for detection of noise. At such state, every time noise is detected input signal travels directly from amplifier 104 to microcontroller 305. Thus, there will be no delay in turning the lights on, instead lights are kept turned on instantaneously. Concurrently, microcontroller 305 receives the last number generated by counter 302, and uses this time delay value to start counting. Further, each time microcontroller 105 receives an input signal from amplifier 104, microcontroller 105 resets its count, to time delay value. So, for as long as noise is detected from microphone 103, the time to turn lights off is delayed. Once time delay value is met, microcontroller 305 switches the position of delay switch 303 and counter switch 304, as seen in FIG. 3*a*, resets time values stored in delay 301 and counter 302, and sends pulse trigger to TRIAC 306 so it can control the voltage for lighting device 105 to turn off. As such, switch 303 and counter switch 304 will be back in its previous lights "OFF" and/or "STANDBY" state, waiting for detection of a noise that will trigger the system again.

Figure 4:
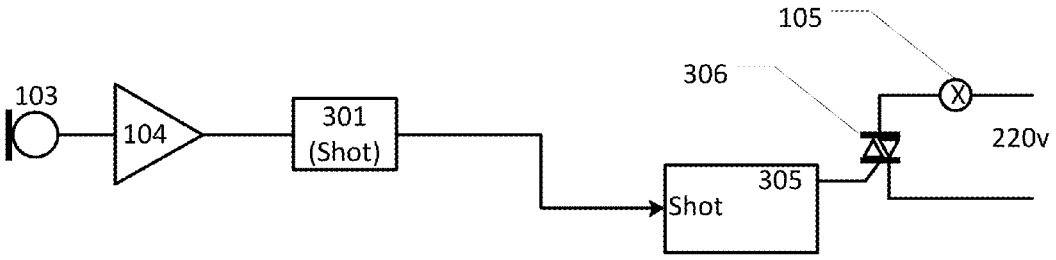
FIG. 4 illustrates an analog electrical circuit diagram.
Figure 5A:
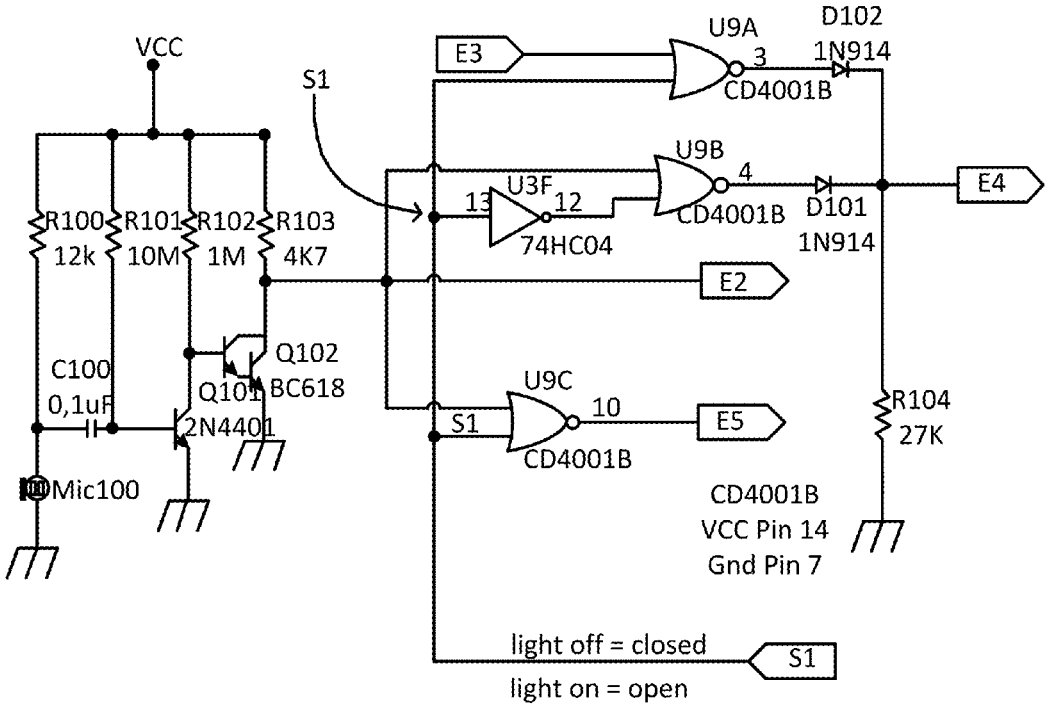
FIG. 5A illustrates how the above described systems and methods could be implemented using purely analog circuitry.
Figure 5B:
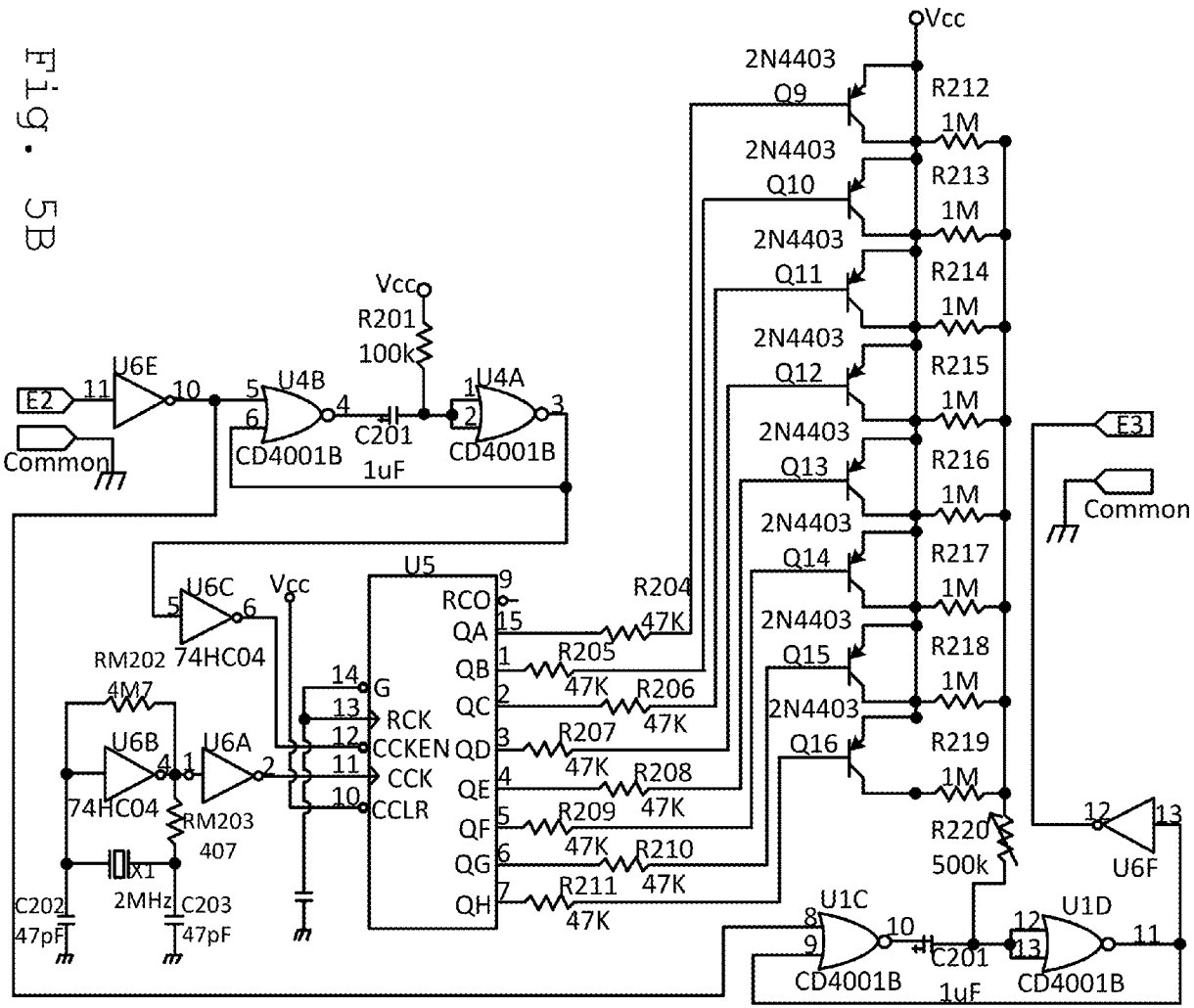
FIG. 5B further illustrates how the above described systems and methods could be implemented using purely analog circuitry.
Figure 5C:
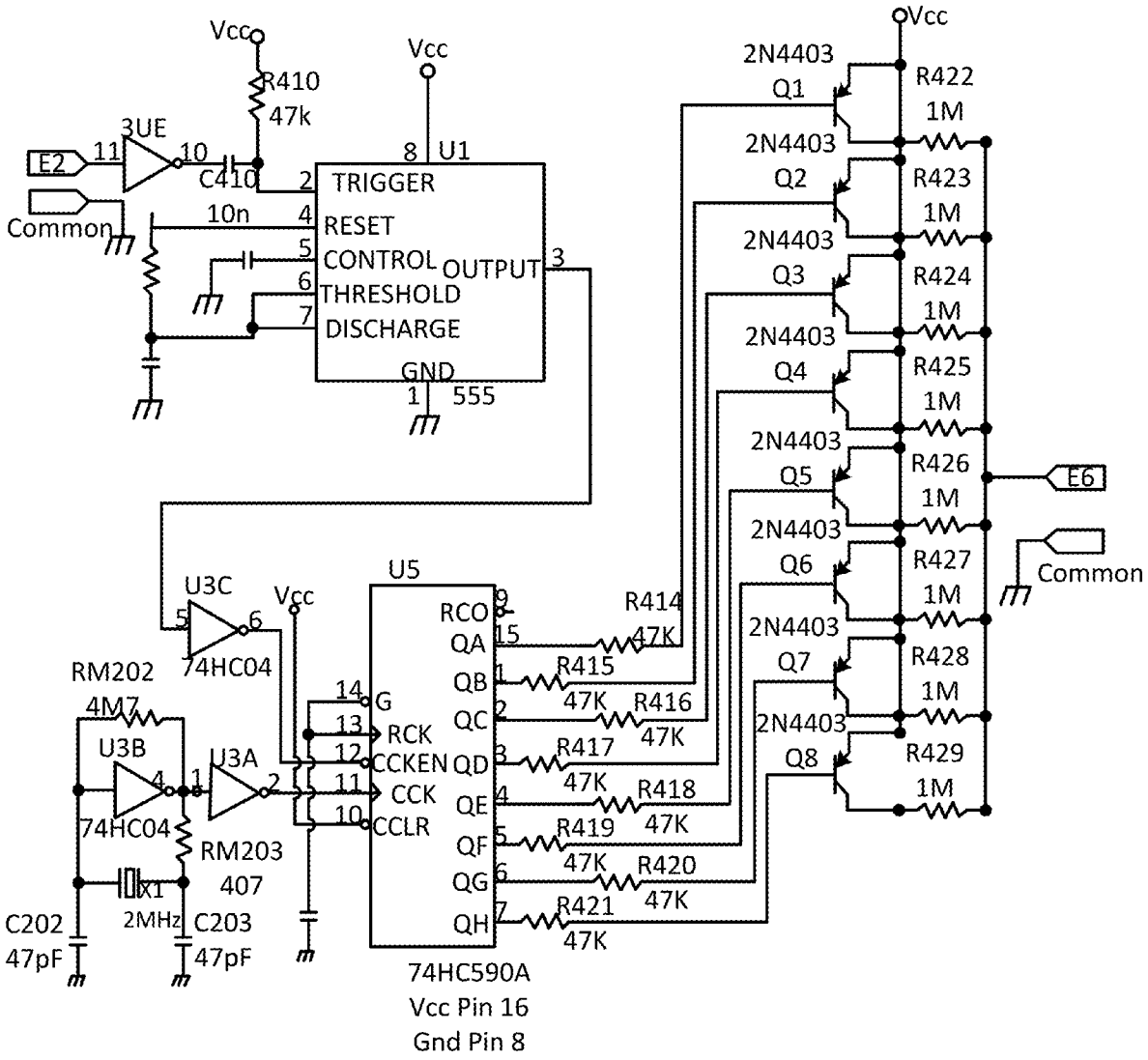
FIG. 5C further illustrates how the above described systems and methods could be implemented using purely analog circuitry.
Figure 5D:
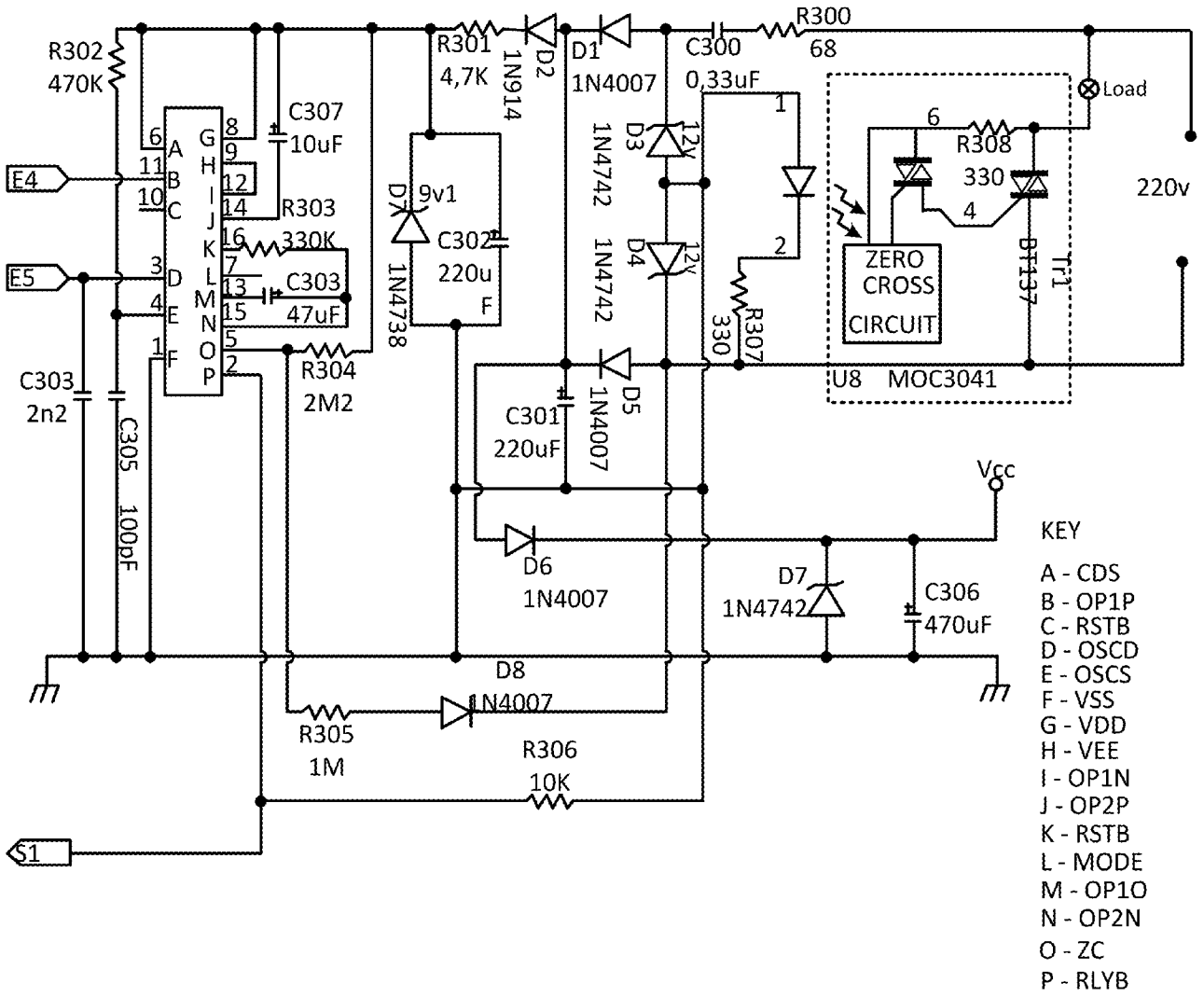
FIG. 5D further illustrates how the above described systems and methods could be implemented using purely analog circuitry.

FIG. 4 illustrates an analog electrical circuit diagram. As such microphone 103, amplifier 104, delay 301, and microcontroller 305 are all connected directly. Further, as for an example, assume that the delay time value in delay 301 is 20 seconds, while microcontroller 305 holds an 8 minutes time delay before lights off. In embodiments, wherein light switch 102 is turned off and/or in STANDBY mode, and sound is detected by microphone 103, microphone 103 converts the sound into analog signal and sends it to amplifier 104. Amplifier intensifies the analog signal and the signal continues to travel to delay 301. Delay 301 that holds delay lights on value of 20 seconds, gets triggered and starts counting down. Once delay 301 met the 20 seconds count, delay 301 sends a signal to microcontroller 305. As such, microcontroller 305 sends trigger pulse to TRIAC 306, and TRIAC 306 powers lighting device 105 to turn on. Simultaneously, microcontroller 305 starts counting down until it reaches 8 minutes to turn the lights off.

Then, wherein microphone 103 detects another noise at 7 minutes and 50 seconds, and delay 301 still holds delay lights on value of 20 seconds, delay 301 starts counting down to 20 seconds, while microcontroller 305 sends trigger pulse to TRIAC 306 to turn the lights off at 8 minutes. Thus, lighting device 105 will be turned off at 8 minutes and will be turned on 10 seconds after. As such gates delay switch 303 and counter switch 304 are needed to make sure that lights are kept ignited for as long as noise is detected within the time delay timeframe.

FIG. 5A, 5B, 5C, 5D illustrate how the above described systems and methods could be implemented using purely analog circuitry.

Figure 6:
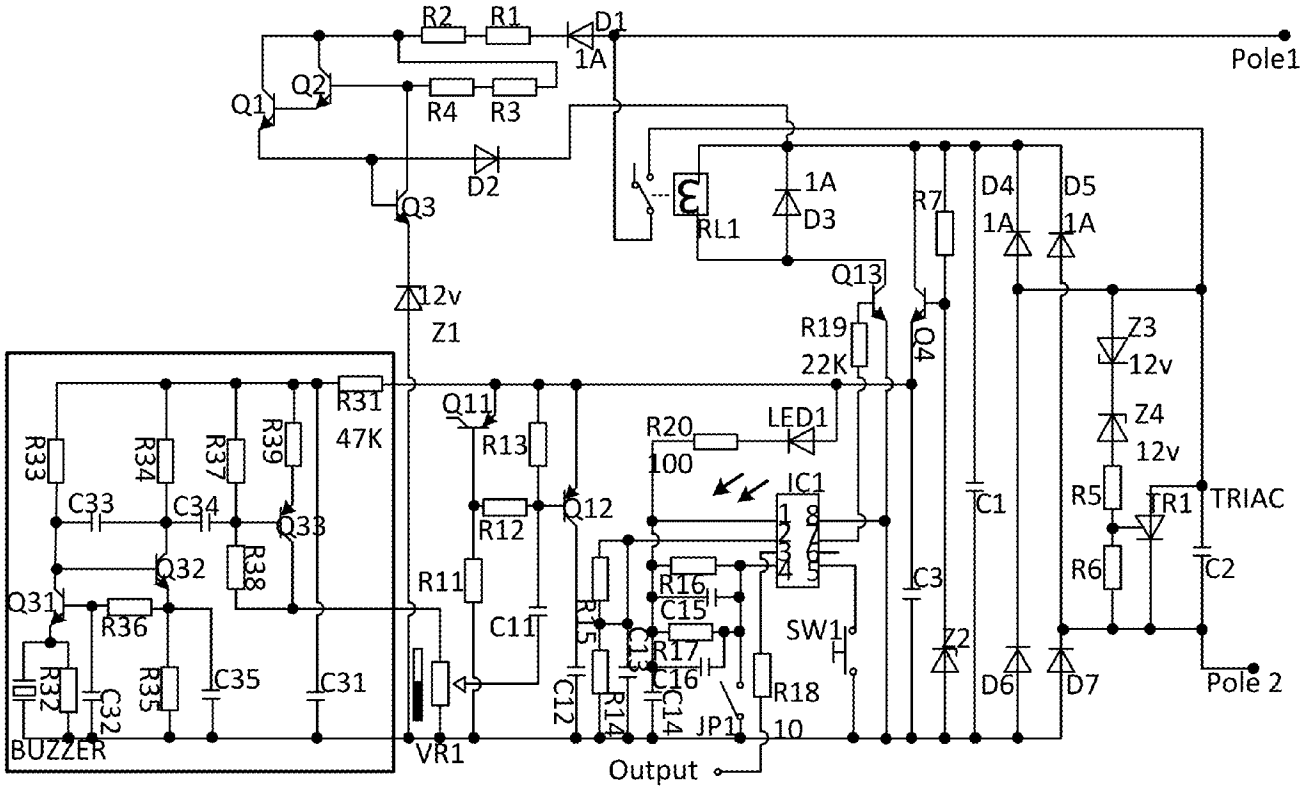
FIG. 6 illustrates an exemplary microcontroller diagram.

FIG. 6 illustrates an exemplary microcontroller diagram.

Figure 7:
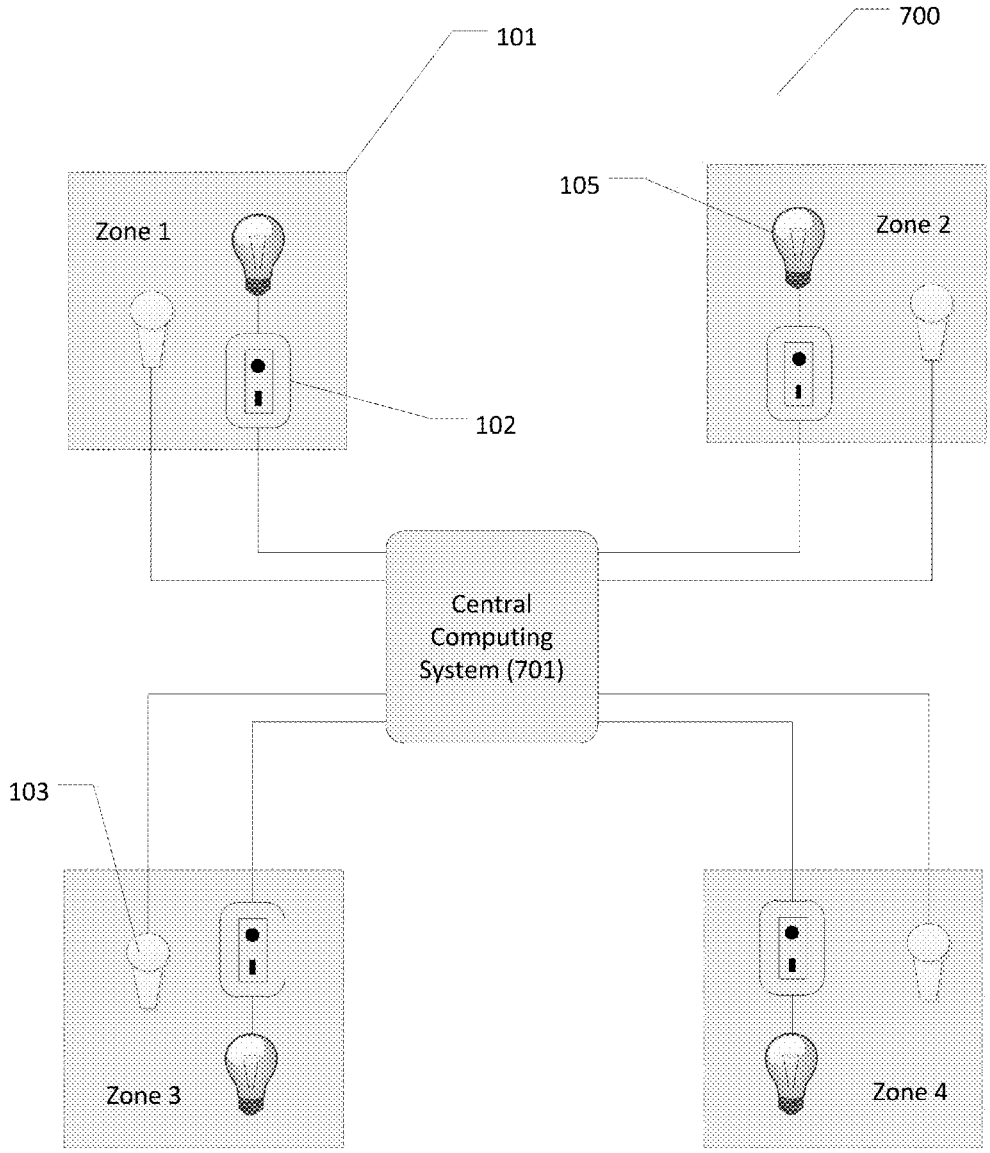
FIG. 7 illustrates one embodiment of delayed light switch system.

FIG. 7 illustrates one embodiment of a delayed light switch system. Delayed light switch system 700 can comprise a central computing system 701, one or more microphones 103, and one or more delayed light switches 102 each capable of controlling one or more lighting devices 105. In one embodiment, one or more microphones 103 can capture sound. Each microphone 103 can convert a sound wave to an electrical signal and transmit such electrical signal to a central computing system 701. Central computing system 701 can either be remote or local. In one embodiment, wires, cables, buses, or common circuitry can connect microphone 103 to central computing system 701. In another embodiment wherein central computing system 701 is remotely connected to microphone 103, microphone 103 can transmit electrical signal to central computing system 701 via a network, wired or wireless.

Central computing system 701 can analyze electrical signal sent by microphone 103. Then, central computing system 701 can determine the location of the sound, can determine if each relevant light switch 102 is in standby mode, and can send directives to operate lighting devices 105 according to instructions in central computing system 701.

Figure 8:
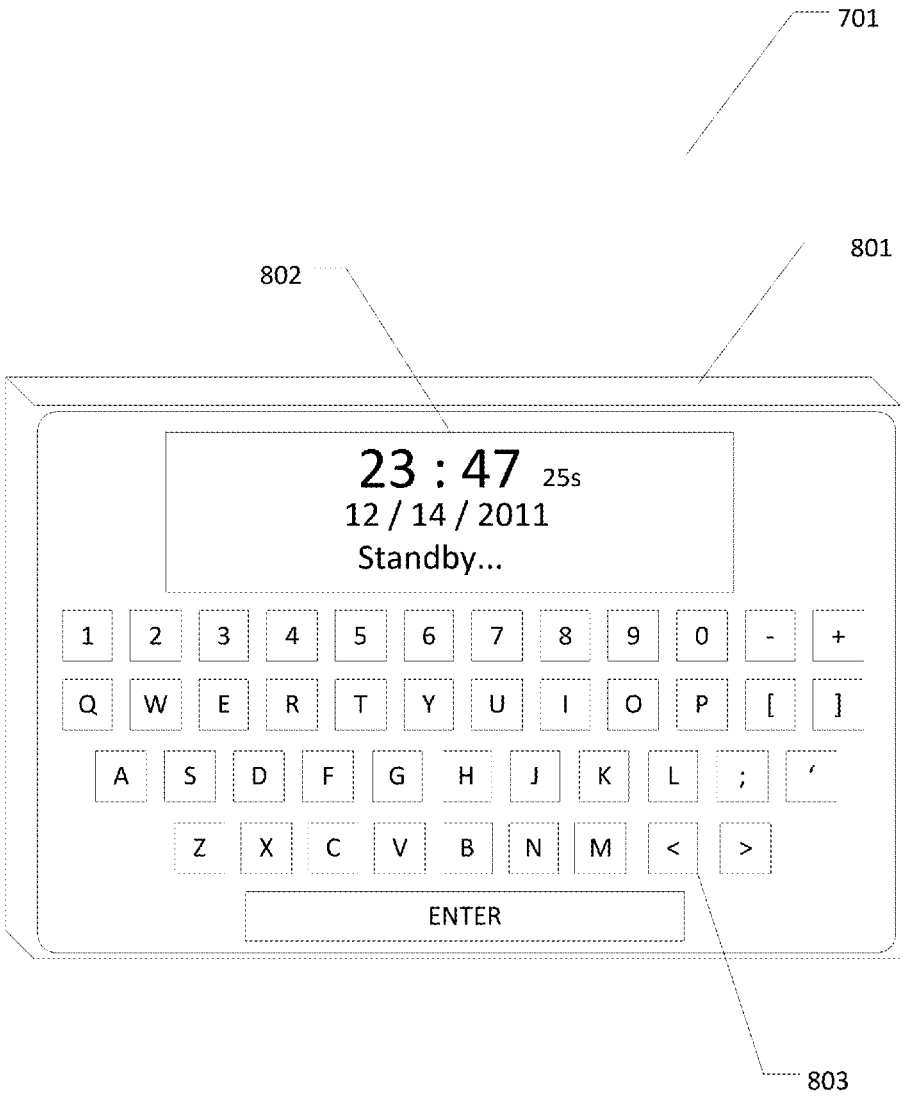
FIG. 8 illustrates a hardware embodiment of central computing system.

FIG. 8 illustrates a hardware embodiment of central computing system 701. In one embodiment, central computing system 701 can comprise a body 801, a display device 802, and/or one or more keypad 803. In such embodiment, body 801 can be in any shape and size, for aesthetics and/or functional reasons. In another embodiment, central computing system 701 can be controlled locally, remotely or a combination of both.

Display device 802 can be any type of screen, including, but not limited to, Liquid Crystal Display (LCD) or any Organic Light Emitting Diode (OLED). In one embodiment, display device 802 can merely display information. In another embodiment, display device 802 can be touchscreen, wherein keypad 803 can mount to display device 802. As such, display device 802, and keypad 803 can be coupled as one device. In one embodiment, keypad 803 can be an alphanumeric keypad. In another embodiment, where display device 802 uses a touchscreen technology, keypad 803 can mount directly to display device 802. Keypad 803 can be used to key-in or set the input values needed by central computing system 701.

Figure 9:
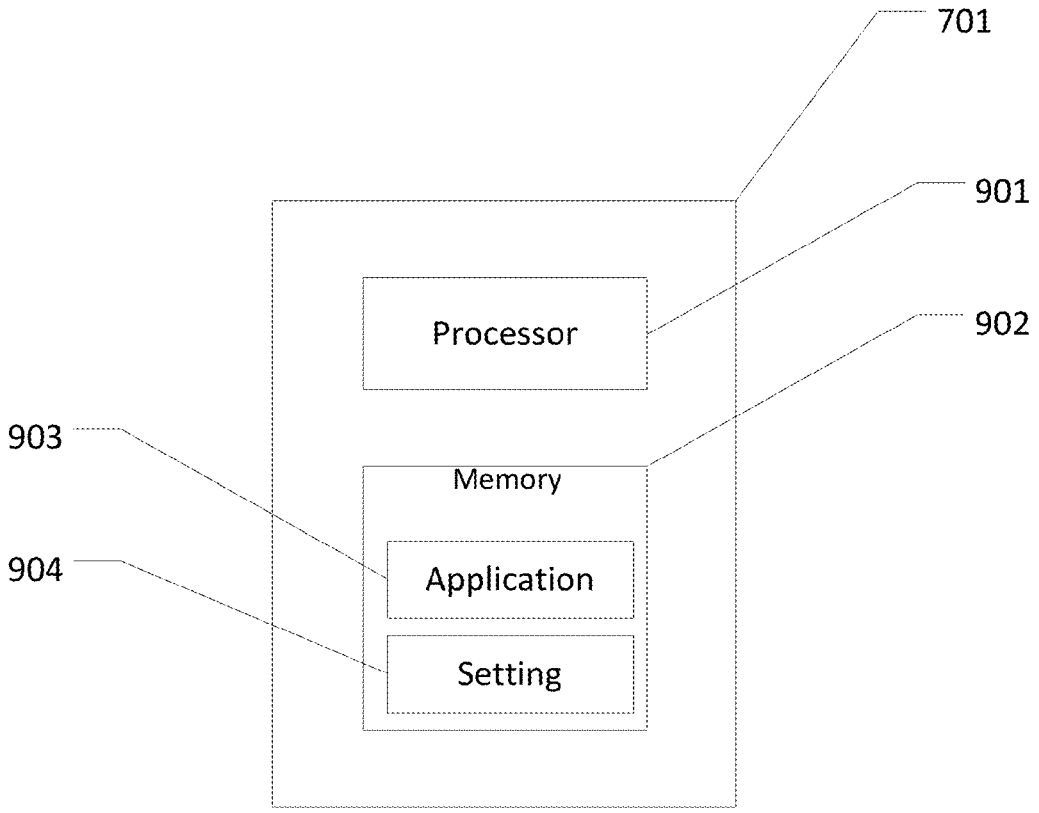
FIG. 9 illustrates the internal hardware for central computing system.

FIG. 9 illustrates the internal hardware for central computing system 701. In one embodiment, central computing system 701 can comprise a processor 901, and a memory 902. Further, memory 902 can comprise an application 903 and stored settings 904. In one embodiment, stored setting 904 can comprise a microphone identifier look-up table. In such embodiment, microphones 103 in each zones, can be associated with a particular zone 101 and/or lightswitch 102 in the microphone identifier look-up table stored in memory. As such, central computing system 701 can determine which light switches 102 to operate depending on which microphone 103 detects noise.

In one embodiment, stored settings 904 can also contain the input values keyed in using keypad 803. Thus, stored settings 904 can contain information that includes but are not limited to delay time, countdown time, zone selection, and noise sensitivity (i.e., thresholds to trip light switches). In such embodiment, a user can adjust stored settings. In another embodiment, values set for delay time and countdown time can be a randomly generated by application 903. In another embodiment, stored settings can be factory set. For purposes of this disclosure, delay time can be the time of delay before lighting devices 105 can be turned on. Delay time is initiated in the system to create a delay longer that typically experienced due to system latency. Such delay makes the lighting appear to be controlled by a human, rather than by a computer. Countdown time can be the time set in a counter before light is turned off. In one embodiment the value set for countdown time can be reset once noise is detected within the countdown time frame by additional noise. As such, light can stay on as long as noise is detected within the countdown time. Furthermore, application 903 can determine time of delay before light turns on and/or off, and status of lights in zones 101 based on settings 904. As such application 903 can analyze each scenario, and can determine the action to be taken for different location, and interval of noise detected. Furthermore, once noise is detected through microphone 103, processor 901 can process the operation of lighting devices 105 based on directives of application 903.

For purposes of this disclosure, central computing system 701 can be local or remote, and can include a hard drive, disc, temporary drive, or any other suitable data storage means. Further, central computing system 701 can be a single device or a plurality of devices, each with a processor and/or memory.

Figure 10:
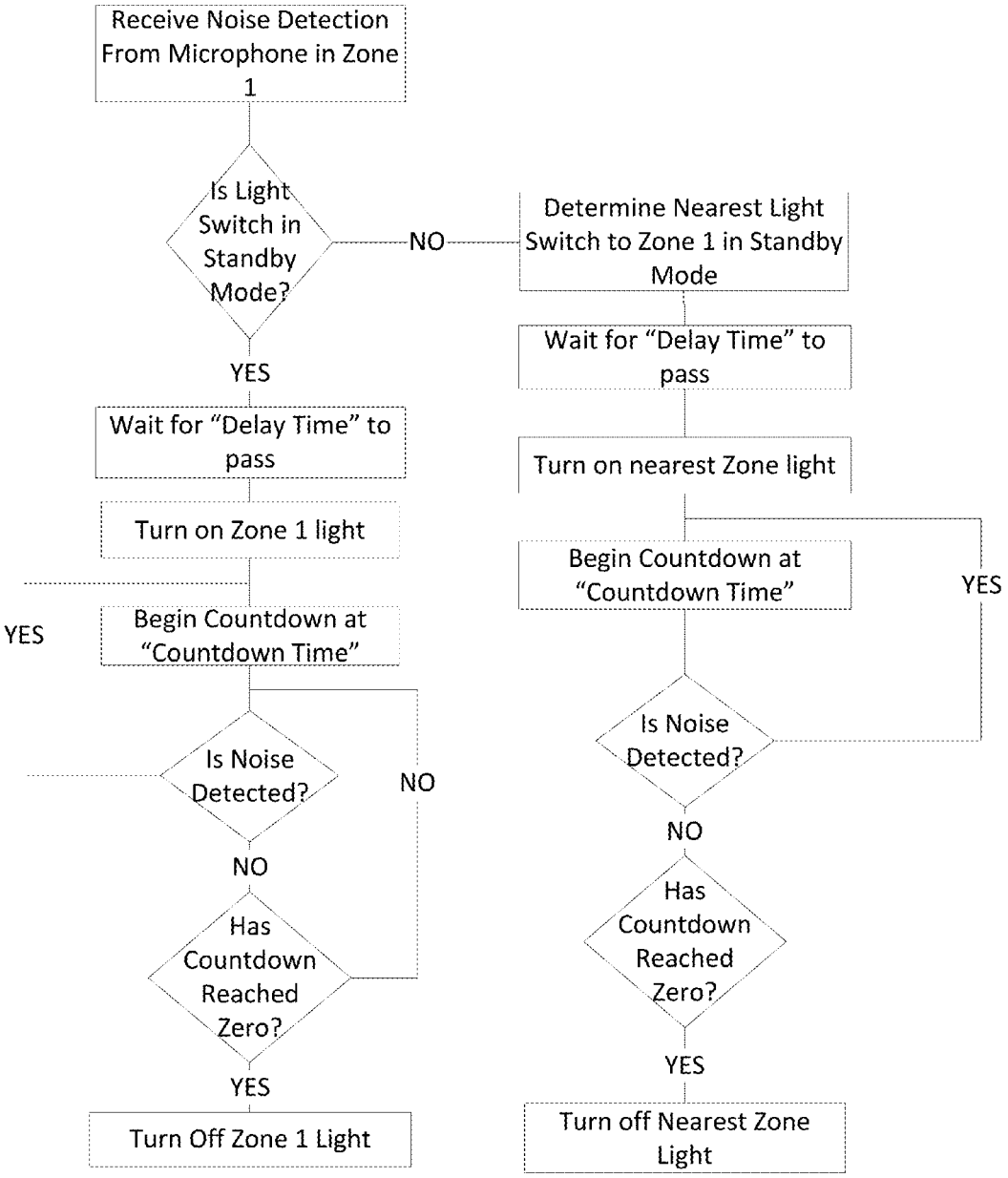
FIG. 10 illustrates a flow chart diagram showing processes of delayed light switch system, wherein lighting device is operated in a zone where noise is detected.

FIG. 10 illustrates a flow chart diagram showing processes of delayed light switch system 700, wherein lighting device 105 is operated in a zone where noise is detected. Microphone 103 can detect noise within zones 101. In one embodiment, wherein noise is detected in zone 1, central computing system 701 can determine whether light switch 102 in zone 1 is set on standby. If light switch 102 is on standby, central computing system 701 can implement delay time. Once delay time passes, central computing system 701 can turn on light switch in zone 1. Then, countdown time can start timing as soon as lighting devices 105 is turned on. In one embodiment, light switch 102 can be reset to standby or turned off automatically after a countdown time has passed. Further in such embodiment, central computer system 701 can be programmed to reset the countdown if additional noise is detected, or it can be programmed to ignore subsequent noises detected. In either case, once countdown has reached zero, central computer system can turn off light switch and/or place it in standby mode.

In a scenario wherein delayed light switch 102 in zone 1 is not set on standby, central computing system 701 can determine a nearest delayed light switch 102 that is set in standby mode. As such, delay time can start timing at the zone nearest to zone 1. Once, delay time is reached, lighting devices 105 at the zone nearest to zone 1 can be turned on. In one embodiment, light switch at the zone nearest to zone 1, can be reset to standby or can be turned off automatically after a countdown time has passed. Further in such embodiment, if additional noise is detected, central computer system 701 can be programmed to reset, or it can be programmed to ignore succeeding noises detected. In either case, once countdown has reached zero, central computer system can turn off light switch and/or place it in standby mode.

Figure 11:
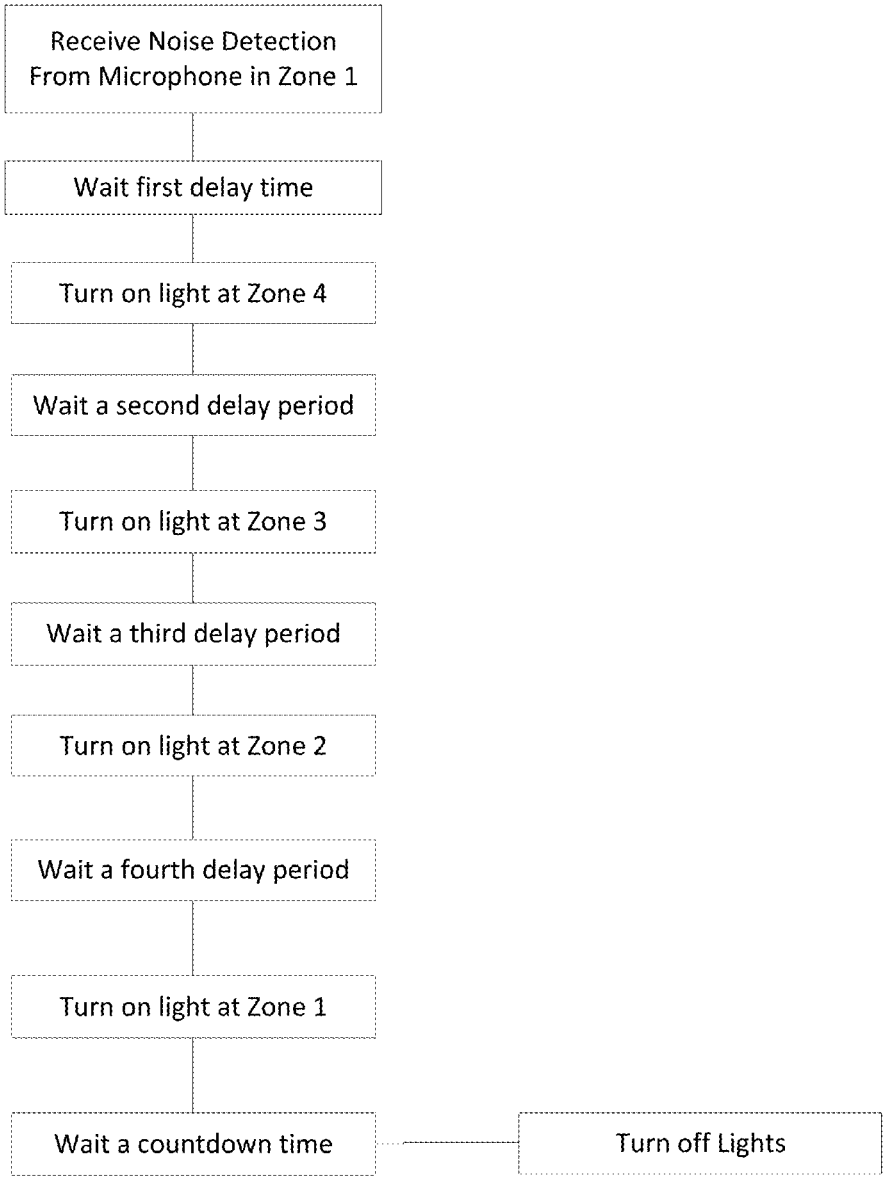
FIG. 11 illustrates a flow chart diagram showing process of delayed light switch system, wherein lighting devices are operated in locations other than zone where noise is detected.

FIG. 11 illustrates a flow chart diagram showing process of delayed light switch system 700, wherein lighting devices 105 are operated in locations other than zone 101 where noise is detected. In one embodiment, lighting devices 105 can be turned on in a sequential order and at different zones. As an example, when noise is detected in zone 1 delay time can start counting. Once delay time is reached, lighting devices 105 at zone 4 can be turned on. Further, delay time can start counting again, and lighting devices 105 at zone 3 can be operated to turn on, after the final count of delay time. The sequence can continue until last zone is reached. Once lighting devices 105 at the last zone 1 is turned on, countdown time begins timing. As such lighting devices in each zone can stay lit up whenever noise is detected within countdown timeframe. Further, once countdown reaches final count and no noise was further detected, lighting devices 105 can be turned off together or separately. For purposes of this disclosure, the sequence of zones that can be operated to delay lights can be predetermined or randomly generated by central computing system 701. In another embodiment, the sequence of zones can be pre-selected and set-up by a user. Further, zones 101 can have different time value for delay time, and countdown time.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A burglary deterrence system comprising
- a microphone that converts a noise into an analog signal;
- an amplifier that
  - receives said audio signal from said microphone; and
  - converts said audio signal into an amplified audio signal;
- a delay that
  - receives said amplified audio signal from said amplifier; and
- applies a delay time to said amplified audio signal;
- a delay switch that
  - in a closed position allows said delay to transmit said amplified audio signal;
  - in an open position prevents said delay from transmitting said amplified audio signal;
- a trigger counter that, upon receiving said amplified analog signal above a second predetermined threshold,
  - generates a counter time; and
  - transmits a counter time;
- a counter switch that
  - in a closed position, allows said trigger counter to receive said amplified analog signal from said amplifier; and
  - in an open position, prevents said trigger counter from receiving said amplified analog signal from said amplifier, and
- a microcontroller than
  - upon receiving said amplified analog signal above a first predetermined threshold sends a control signal to turn on a light.

2. The burglary deterrence system of claim 1 wherein said microcontroller further
- receives said counter time from said trigger counter;
- switches said delay switch from a closed position to an open position; and
- switches said counter switch from a closed position to an open position.

3. The burglary deterrence system of claim 2 wherein said microcontroller further
- waits until counter time passes;
- sends a control signal to turn off said light;
- switches said delay switch from an open position to a closed position; and
- switches said counter switch from an open position to a closed position.

4. The burglary deterrence system of claim 3 wherein said delay switch further allows said amplifier to send an amplified analog signal directly to microcontroller when in an open position, further wherein said microcontroller restarts said waiting for said counter time to pass upon receiving said analog audio signal from said amplifier above said first predetermined threshold.

5. The burglary deterrence system of claim 1 wherein said first determined threshold is zero.

6. The burglary deterrence system of claim 1 wherein said second determined threshold is zero.

7. A method for deterring a burglary, comprising the steps converting a noise into an analog signal with a microphone;

receiving from said microphone said audio signal and converting said audio signal into an amplified audio signal, with an amplifier;

receiving from said amplifier said amplified audio signal and applying a delay time to said amplified audio signal using a delay;

preventing said delay from transmitting said amplified audio signal when a delay switch is in a closed position, and allowing said delay to transmit said amplified audio signal when said delay switch is in an open position;

receiving said amplified signal by a trigger counter, and if said amplified signal is above a second predetermined threshold, generating and transmitting a counter time by said trigger counter;

allowing said trigger counter to receive said amplified audio signal from said audio amplifier if a counter switch is in a closed position, and preventing said trigger counter from receiving said amplified audio signal from said amplifier if said counter switch is in an open position; and receiving said amplified audio signal by a micro controller, and if said audio signal is above a first predetermined threshold, sending a control signal to turn on a light by said micro controller.

8. The method of claim 7, further comprising the steps receiving said counter time from said trigger counter by said microcontroller;

switching said delay switch from a closed position to an open position by said microcontroller; and switching said counter switch from a closed position to an open position by said microcontroller.

9. The method of claim 8 further comprising the steps sending a control signal to turn off said light by said light by said microprocessor;

switching said delay switch from an open position to a closed position by said microprocessor; and switching said counter switch from an open position to a closed position by said microcontroller.

10. The method of claim 9 further comprising the steps allowing said amplifier to send an amplified analog signal directly to microcontroller when said delay switch is in an open position, further wherein said microcontroller restarts said waiting for said counter time to pass upon receiving said analog audio signal from said amplifier above said first predetermined threshold.

11. The method of claim 7 wherein said first predetermined threshold is zero.

12. The method of claim 7 wherein said second predetermined threshold is zero.

* * * * *